United States Patent [19]

Ahl et al.

[11] Patent Number: 4,811,033

[45] Date of Patent: Mar. 7, 1989

[54] ANTENNA SURFACE CONTOUR CONTROL SYSTEM

[75] Inventors: Elvin L. Ahl, Yorktown; James B. Miller, Norfolk, both of Va.

[73] Assignee: National Aeronautics and Space Administration, Washington, D.C.

[21] Appl. No.: 118,995

[22] Filed: Nov. 10, 1987

[51] Int. Cl.[4] ..... H01Q 9/34

[52] U.S. Cl. ..... 343/880; 343/915; 343/DIG. 2

[58] Field of Search ..... 343/880, 881, 915, DIG. 2

[56] References Cited

U.S. PATENT DOCUMENTS

| | | | |
|---|---|---|---|
| 3,739,538 | 6/1973 | Rubin | 343/881 |
| 4,352,113 | 9/1982 | Labruyeré | 343/915 |
| 4,587,777 | 5/1986 | Vasques et al. | 343/880 |

FOREIGN PATENT DOCUMENTS

| | | | |
|---|---|---|---|
| 0174715 | 3/1986 | European Pat. Off. | 343/DIG. 2 |

OTHER PUBLICATIONS

NASA Contractor Report No. CR-3558, "LSST (Hoop/Column) Maypole Antenna Development Program", Parts 1 and 2, dated Jun. 1982.

*Primary Examiner*—William L. Sikes
*Assistant Examiner*—Doris J. Johnson
*Attorney, Agent, or Firm*—Harold W. Adams; John R. Manning; Charles E. B. Glenn

[57] ABSTRACT

The invention is a system for automatically controlling the surface contour of a deployable and restowable antenna 11 having a mesh reflector surface 26 supported by a circular, folding hoop 12 affixed to a central, telescoping column 14. The antenna 11, when deployed, forms a quad-aperture reflector with each quadrant A-D of the mesh surface 26 shaped to provide an offset parabolic RF reflector.

The hoop 12 is supported and positioned by quartz support cords 12 attached to the top 22 of column 14 and by lower graphite hoop control cords 23 that extend between the hoop 12 and base 24 of the column 14. The antenna 11, an RF reflective surface 26, is a gold plated molybdenum wire mesh supported on a graphite cord truss structure that includes the hoop control cords and a plurality of surface control cords 27 attached at selected points on the surface 26 and to the base 24 of column 14. The contour of the three-dimensional surface 26 of the antenna 11 is controlled by selectively adjusting the lengths of the surface control cords 27 and the graphite hoop control cords 23 by means of novel actuator assemblies 56 that automatically sense and change the lengths of the lower hoop control cords 23 and surface control cords 27 to control the contour of the surface 26 of the antenna 11.

11 Claims, 7 Drawing Sheets

ANTENNA SURFACE CONTOUR CONTROL SYSTEM

ORIGIN OF THE INVENTION

The invention described herein was made by employees of the United States Government and may be manufactured and used by or for the Government for governmental purposes without the payment of any royalties thereon or therefor.

BACKGROUND OF THE INVENTION

1. Field of the Invention

The National Aeronautics and Space Administration is involved in the development of large structures that may be either assembled in space or deployed after launch into space.

This invention relates to such a large structure as a deployable and restowable parabolic antennae for use in space to Earth and other communications systems.

2. Description of Prior Art

The concept of deployable and restowable large diameter, hoop-column mesh-type antennae for use in space is broadly known.

The desirability of providing this type of hoop-column mesh antenna with manual means for adjusting the contour of the antenna to a selected three-dimensional contour is also known.

The conventional manual method and apparatus for selectively adjusting the individual hoop and surface cords to accomplish this adjustment has been performed on Earth and found to be tedious and time-consuming, requiring up to eight hours to perform. Further such adjustment is limited to a deployed surface accuracy of approximately 0.01 inch. Such a deployment and adjustment in space would likely take far longer with less accuracy in providing the desired and critical antenna surface contour for use in space communications systems.

An object of the invention is to provide a control system for automatically adjusting the lengths of a plurality of control cords to control the surface contour of a hoop-column type antenna.

A further object of the invention is to provide a plurality of actuator assemblies mounted on said antenna to selectively and individually or simultaneously adjust the lengths of said plurality of control cords to control the surface contour of said antenna.

Still another object is to provide command signal means for controlling said actuator assemblies.

SUMMARY OF THE INVENTION

The above and numerous other objects and advantages are achieved by invention which includes motor driven actuator assembly means for sensing the actual lengths of the control cords of a hoop-column antenna and adjusting them to predetermined lengths to automatically control the contour of the antenna surface.

BRIEF DESCRIPTION OF THE DRAWINGS

The above and numerous other objects and advantages of the invention will become apparent from the following Detailed Description of same when read in view of the accompanying drawings wherein.

DESCRIPTION OF THE PRIOR ART

Figure 1:
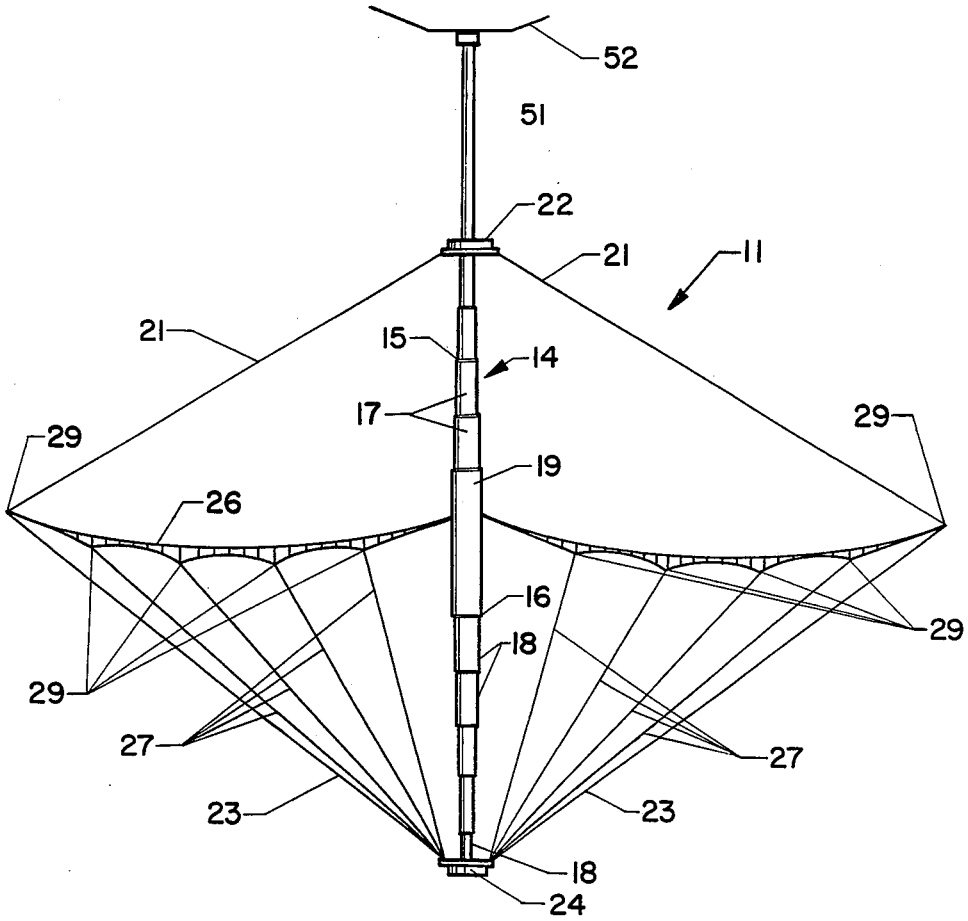
FIGURE 1 PRIOR ART
FIG. 1 is a front view in partial section of a conventional hoop-column mesh antenna shown in a deployed position.

Referring to the drawings, FIGS. 1–4 illustrate a conventional deployable and restowable hoop-column antenna generally designated by the reference numeral 11 and which may be fifteen meters or more in diameter.

Figure 2:
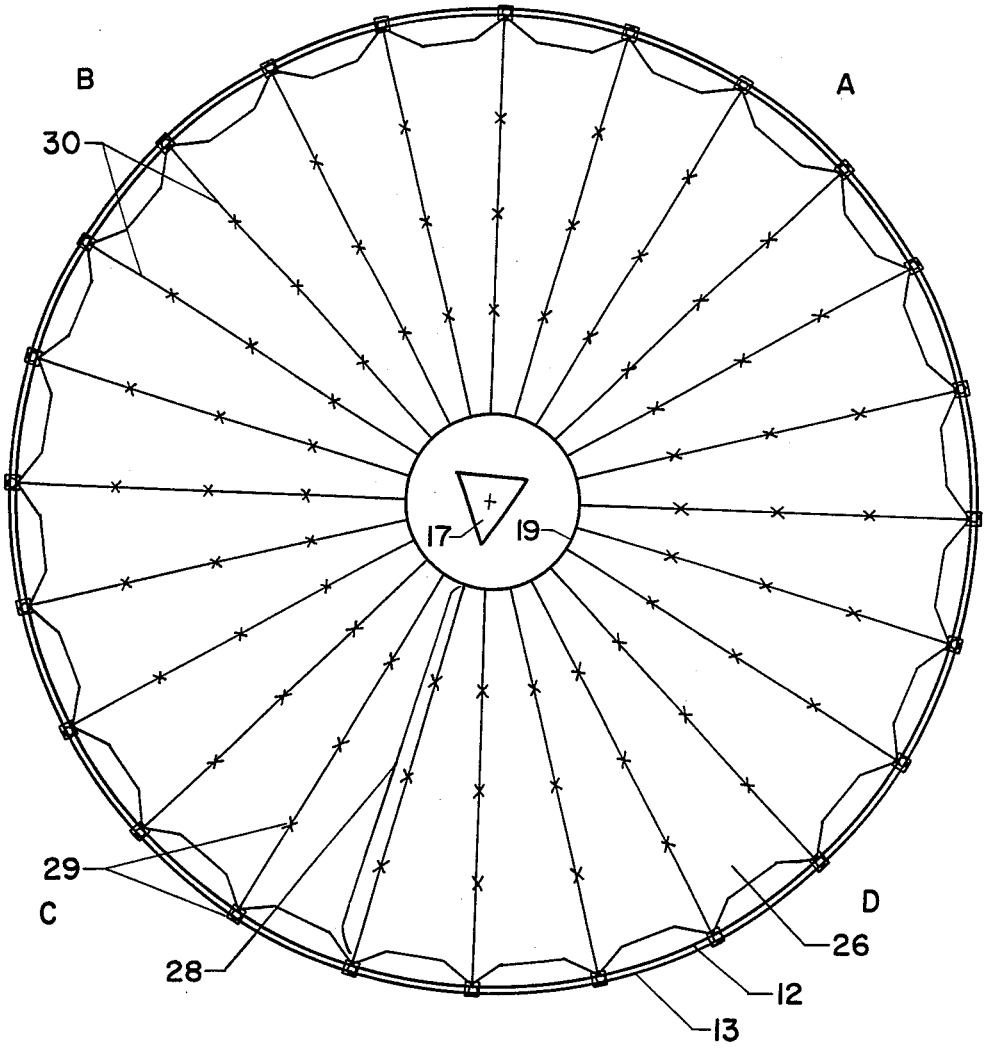
FIGURE 2 PRIOR ART
FIG. 2 is a plan view of the conventional deployed antenna shown in FIG. 1.

The antenna 11 is supported by a folding hoop 12, formed of hinged links 13 affixed to a central telescoping column generally designated by the reference numeral 14 formed by upper and lower mast sections 15 and 16 respectively which are formed of telescoping, triangularly shaped segments 17 and 18 that extend from a central hub 17 When deployed, as shown in FIGS. 1 and 2, the antenna forms a quad-aperture RF signal antenna, each quadrant A-D being adjustably shaped to provide an offset parabolic RF signal reflector.

The hoop 12 is supported by forty-eight (48) upper and circumferentially spaced quartz hoop support cords 21 attached to the top 22 of the upper mast section 15 and by twenty-four (24) circumferentially spaced lower hoop control cords 23 attached to a circular base 24 upon which the bottom lower segment 18 of lower mast section 16 is mounted.

The antenna 11, an RF reflective surface or membrane 26 formed of a gold plated molybdenum wire mesh is supported on a graphite cord truss structure between the hoop 12 and circular base 24 that includes ninety-six (96) circumferentially spaced surface control cords 27 attached to the hoop 12 and the circular base 24 and the twenty-four (24) lower hoop control cords 23 as previously described.

As shown in FIG. 2, the surface and lower hoop control cords 27 and 23 may be attached to the antenna surface 26 in a plurality of cord groups 28 of five (four surface and one lower hoop control cord) per group, there being twenty-four of such groups 28 circumferentially spaced around and which are attached to the surface 26 at spaced truss points 29 along radial lines 30 that extend from the central hub 19 to the hoop 12. Adjacent and correspondingly positioned surface control cord truss points 29 in the twenty-four cord groups form four concentric circles in the antenna surface 26.

Figure 3:
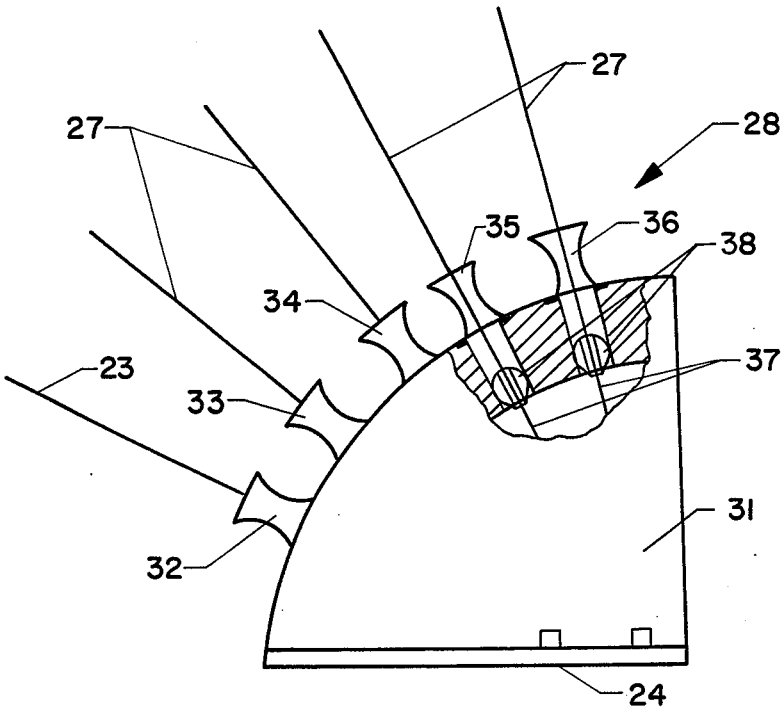
FIGURE 3 PRIOR ART
FIG. 3 is a partial cross-sectional view of one of a plurality of lower stop brackets circumferentially spaced around a circular antenna base for providing a guide for 96 surface control cords and 24 hoop control cords of the antenna shown in FIG. 1.

As shown in FIG. 3, the lower end of each cord 27 and 23 of each cord group 28 is attached to one of a plurality of semi-circular lower stop brackets 31 that extend radially from the upper surface of the circular base 24.

Each lower bracket 31 includes five identically shaped funnel shaped control cord guides 32–36 respectively that open into the interior of the lower stop bracket 31 and which receive the ends 37 of the cords in each cord group 28. The ends 37 are secured in the lower stop bracket 31 by means of a bead member 38 affixed to each of said control cords of larger diameter than the neck of the respective funnel shaped guide 32–36 in which received.

Figure 4:
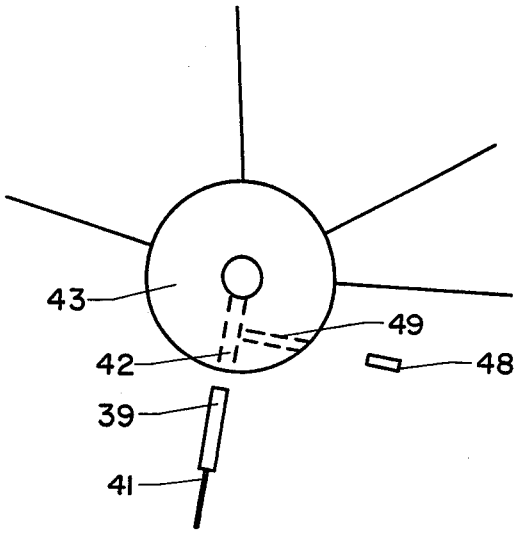
FIGURE 4 PRIOR ART
FIG. 4 is an enlarged perspective of one of a plurality of truss points illustrating conventional manual means for selectively adjusting the length of the surface and hoop control cords of the antenna shown in FIG. 1.

As shown in FIG. 4, a metal sleeve 39 on the upper end 41 of each surface control cord 27 and each lower hoop control cord 23 is received in a radially extending bore 42 in one of a plurality of flat, circular discs 43 that form the truss points 29 attached at selected points to the underside of the mesh forming the antenna reflective surface 26 as previously described. The length of the metal sleeves 39 which are adjustably secured in the respective bores 42 in which received by means of set screws 48 threadably received in transverse passages 49 that open into the respective bores 42 determines the stroke or length of adjustment of each surface control cord 27 and lower hoop control cord 23.

As shown in FIG. 2, a plan view of the antenna 11 in a deployed position, the antenna 11 provides four quadrants A-D, respectively, each forming a parabolic RF reflector. The truss points 29 for the lower hoop control cords 23 are circumferentially spaced about the hoop 12 in diametrically opposed pairs, there being twelve such pairs in all. The four surface control cords 27 and one lower hoop control cord 23 forming each cord group 28 are radially spaced in a straight line 30 extending from the central hub 19 to the hoop 12.

When in a stowed position, the motor actuated and hinged links 13 forming the hoop 12 are folded together to form a cylindrical housing around the central hub 19 into which the triangular shaped segments 17 and 18 forming the upper and lower mast sections 15 and 16 are telescoped, one inside the other, by means of a suitable motor driven cable and pulley arrangement (not shown) mounted on the center hub 19. The mesh forming the surface 26 of the antenna 11 is folded and stored between the cylindrical housing and the outside wall of the central hub 19. A feed mast 51 affixed to the upper mast section 15 carries an RF signal feed assembly 52.

During deployment, as the upper and lower mast sections 15 and 16 extend, each telescoping segment 17 and 18 latches to the adjacent and last segment to extend. As the bottom segment 18 attached to the base 24 is extended, the surface control cords 27 and lower hoop cords 23 are pulled from individual spring biased storage spools 53 suitably mounted on the base member 24. The upper hoop support cords 21 are similarly pulled from storage spools not shown mounted at the top 22 of the upper mast section 15. This extension is accomplished by a motor driven and threaded rod affixed to the last segment 18 which moves the column 14 to a fully extended position.

Thereafter the hinged links 13 are unfolded outwardly by motor driven parallelogram arms (not shown) to form the hoop 12 and position the surface 16 in a first deployed position, all of the metal sleeves 39 on the surface control and lower hoop control cords 27 and 23 having first been secured in the bores 42 of the respective discs 43 at the truss points 29 in which received by means of the associated set screws 48.

Likewise the beads 38 are also affixed to the respective surface control cords 27 and lower hoop control cords 23 to preset the length of each such cord as calculated to provide the desired or ideal surface contour for each parabolic quadrant A-D respectively of the deployed antenna 11. Thus, the lengths of the control cords 23 and 27 determines the relative three-dimensional positions of the truss or selected points 29 on the antenna and thus the contour of the antenna surface 26.

Even with the lengths of the surface control and hoop control cords 27 and 23 preset and the quadrants A-D of the antenna thereafter deployed to the final position as described, the contour of the antenna surface 26 may vary during deployment requiring the manual adjustment of the control cord sleeves 39 to control the contour of each parabolic antenna surface (A-D) to assure the maximum RF signal reflection.

The deployment and subsequent manual adjustment of this type of conventional antenna on Earth has been found to require many hours of tedious work while achieving a surface contour accuracy within only 0.01 inch. It has also been found necessary to repeat much of the previous manual adjustment when a once deployed antenna is redeployed from a stowed position in a zero gravity environment.

DETAILED DESCRIPTION OF THE INVENTION

Referring to FIGS. 5–9, a preferred embodiment of the invention is shown as generally comprising a plurality of actuator assemblies generally designated by the reference numberal 56 radially spaced around the circular base 24 of a conventional antenna 11 as shown in FIGS. 1–4 and as previously described, the same reference numerals being used for like elements in the following description. As shown in FIG. 2, the antenna surface contour control system requires twenty-four (24) actuator assemblies 56.

Figure 5:
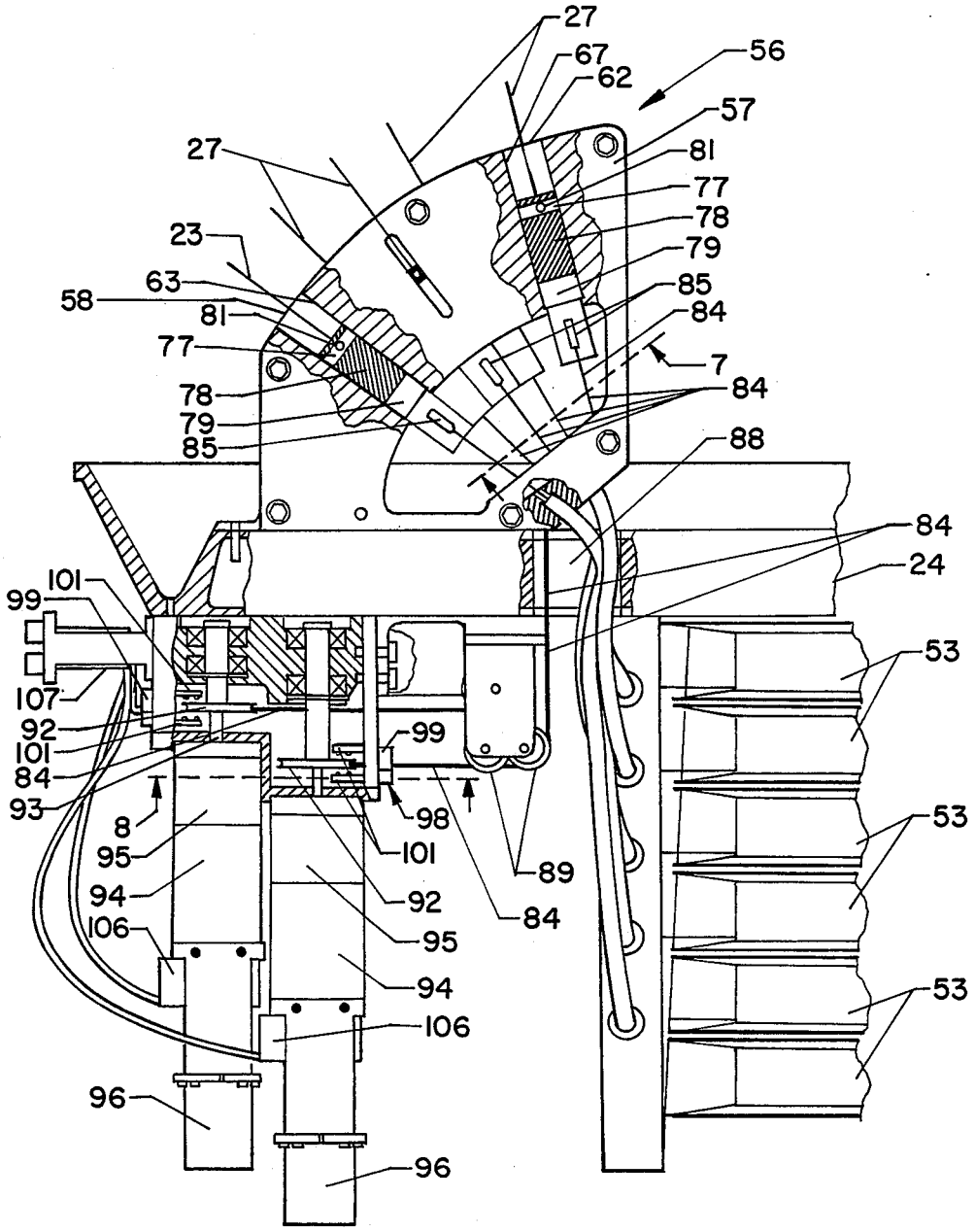
FIG. 5 is a perspective, partial sectional view of one of 24 actuator assemblies circumferentially spaced around a conventional antenna base as shown in FIG. 1.
Figure 6:
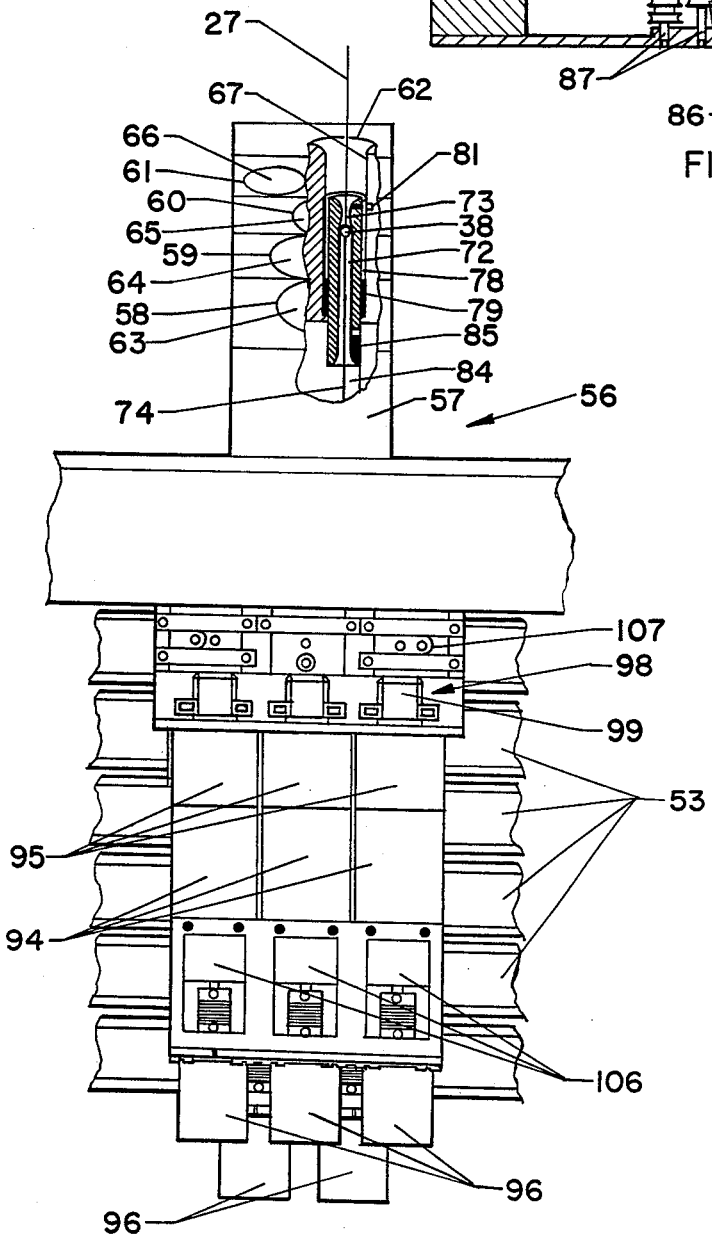
FIG. 6 is a left end view of the actuator assembly shown in FIG. 5 and including a spring loaded piston in a lower stop block in the actuator assembly.

As shown in FIGS. 5 and 6, each actuator assembly 56 includes a semi-circular shaped stop block 57 provided with five radially extending and offset passages 58–62 that form cylinders 63–67 for displaceably receiving hollow pistons 68–72 respectively through which four surface control cords 27 and one hoop control cord 23 forming a cord group 28 as previously described pass. Each control cord 27 and 23 is provided with a bead member 38 larger in diameter than an upper throat 73 internally formed in each piston 68–72, thus preventing each control cord from being pulled upwardly from the respective piston 68–72 in which received.

The free end 74 of each control cord 23 and 27 is attached to an individual, spring loaded take up spool 53 arranged to maintain sufficient tension to prevent any slack in the respective lower hoop and surface control cords 23 and 27 respectively. The opposite end of each control cord 23 and 27 is fixedly attached to a truss point 29 by means of a set screw 44 as previously described.

Each piston 68–72 is provided with a head 77 that confines a surrounding compression spring 78 within the cylinder 63–67 in which received between the head 77 and a cylindrical spacer 79 at the bottom of the cylinder that serves as a first piston stop means for controlling the length of stroke or travel of the piston in a first downwardly direction (approximately 0.75 inch in the preferred embodiment, but variable).

Each piston 68–72 is also provided with a stop pin 81 that projects through an elongated slot 82 in the side wall of the stop block 57 and which extends parallel with the cylinder 63–67 in which the associated piston 68–72 is received. The stop pin 81 and elongated slot 82 provide a second piston stop means for controlling the length of travel of the respective piston in a second and opposite direction. As shown in FIGS. 5 and 6 the five cylinders 63–67 are slightly offset, three of the elongated slots 82 being formed in the front face 83 of the stop block and two in the back face of the stop block 57.

Figure 7:
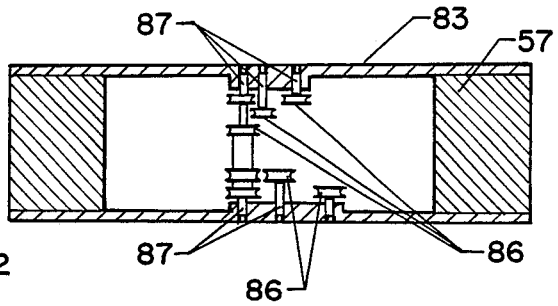
FIG. 7 is a plan view of a guide pulley assembly taken along lines 7—7 in FIG. 5.
Figure 8:
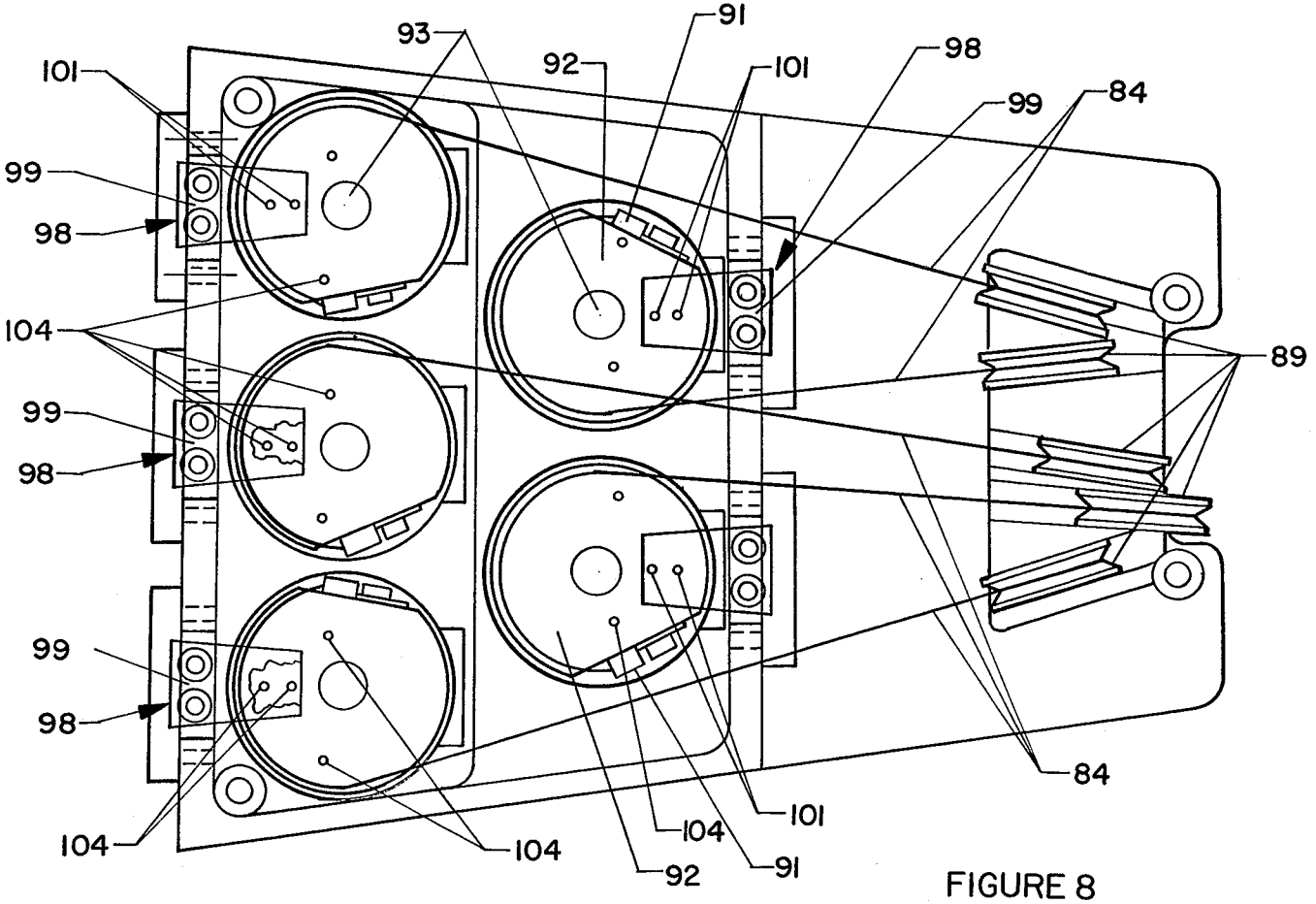
FIG. 8 is a plan view of an arc sector drive pulley arrangement taken along the lines 8—8 in FIG. 5.

As shown in FIG. 7, actuator cables 84 attached to the end bosses 85 on pistons 68–72 pass over an upper assembly of guide pulleys 86 mounted on shafts 87 in the stop bracket 57 and through an opening 88 in the antenna base 24, before passing over a lower assembly of guide pulleys 89. Each actuator cable 84 is tangentially attached to an arc-sector point 91 on a drive pulley 92 of a known diameter as shown in FIG. 8.

Each drive pulley 92 is mounted on a shaft 93 driven by a reversible torque motor 94 through a gearhead 95 to take up the actuator cable 84 connected thereto. This in turn pulls the attached piston 68–72 against the bead 38 of the associated control cord 23 or 27 and its surrounding compression spring 78, the spring loaded spool 53 taking up the resulting slack in the control cord being adjusted. The travel or stroke of any piston 68–72 is determined by its associated first and second stop means as previously described. Its initial position in the associated cylinder 63–67 is determined by the compression spring 78 and the tension in the actuator cable 84.

The torque motors 94 and associated gearheads 95 are commercially available units. For instance, a Maxon Gearhead Motor, Model No. 2434.970.53.225-200 manufactured by Interelectric-AG, CH-6072, Sachslen, Switzerland operates satisfactorily in practicing the invention. Each torque motor 94 is provided with an external brake 96 that is normally on when the associated torque motor 94 is off and off when the torque motor is on, thus preventing back-driving of the associated drive pulley 92 when the torque motor 94 is de-energized. The brake motor 96 is also commercially available. For instance Fail Safe Brake Model No. R611-01 manufactured by Pic Design Corporation, P.O. Box 1004, Middlebury, Conn. has been found to serve the desired function.

Drive shaft 93 of each torque motor 94 actuates an actual shaft position encoder 98 referenced to an arc-sector point position sensor 99 that senses the circumferential travel of of each drive pulley 92.

As shown in FIG. 8 each actuator cable 84 is wrapped approximately 180° around the respective drive pulley 92 to which it is tangentially attached at an arc-sector point 91 the rotation of which determines the displacement of one of the pistons 68–72 to which attached and thus the length of the control cord 27 or 23 adjusted thereby. The position of each arc-sector point 91 is sensed by two pair of spaced optical emitter-detectors 101, Model OP224 Emitters and OP305 Detectors made by Hewlett Packard Corporation, P.O. Box 37000, Raleigh, N.C. mounted adjacent the periphery of each drive pulley 92 and between which the drive pulley rotates.

Each detector includes a light source and a light sensor which is actuated to provide an arc-sector point position signal when either one or two of four (4) holes 104 through each drive pulley 92 pass between the light source and sensor of each detector 101. A pair of holes 104 are spaced on the same radial while two of the holes 104 are spaced from the radial and the drive shaft 93.

Initially and prior to deployment of the antenna 11, the tension in each actuator cable 84 in the system is adjusted so that the pair of holes 104 are positioned between the light sources and sensors of the spaced pair of detectors 101, each of the pistons 68–72 to which the actuator cables are (zero degree position) attached being positioned midway of its respective cylinder 63–67 against a compression spring 78. In this position, each control cord 23 and 27 is adjusted to a predetermined and ideal length.

As in the conventional antenna, the lengths of the respective control cords 23 and 27 determine the relative, three-dimensional positions of the truss points 29 to which the control cords are attached to control the contour of the antenna surface 26. The actual position encoders 98 are responsive to the arc-sector point position signals from the optical emitter-detectors and the sensors 99. Upon a zero degree signal from the detectors 101 the actual position decoder 98 momentarily resets the microcontroller actual position data to zero.

An incremental encoder 106 such as a 28 mm diameter incremental optical encoder, Model HEDS 5010 A06 made by Hewlett Packard Corporation, P.O. Box 37000, Raleigh, N.C. also mounted on the drive shaft 93 of each motor 94 is mechanically coupled to a drive pulley 92 by the gearhead 95 and provides two quadrature and one index signal per revolution of the drive shaft 93, the gearhead 95 being arranged so that the drive shaft 93 rotates a determined number of times for each rotation of the drive pulley 92 and its arc-sector point 91.

As previously described, the pattern of the four (4) holes 104 on each drive pulley 92 produce arc-sector point position signals at the zero degree position and upper and lower angular limit positions of rotation of the arc-sector point as determined by the spaced holes 104. The output signals of the pairs of detectors 101 and the index signal from the incremental encoder 106 are applied to an AND logic circuit in a micro-controller 107 for each actuator assembly 56 to produce three absolute reference positions (zero degree, upper and lower) for each arc-sector point 91 accurate to the resolution of the incremental recorder 106.

The micro-controller 107, which may be a commercially available device such as an Intel 8797 BH micro-controller made by Intel Corporation, 3065 Bowers Avenue, Santa Clara, Calif. 95051, includes a nonvolatile memory programmed to store the ideal zero degree position signal of each arc-sector point 91 for each actuator cable 84 in each actuator assembly and to which each is set prior to deployment as previously described.

Figure 9:
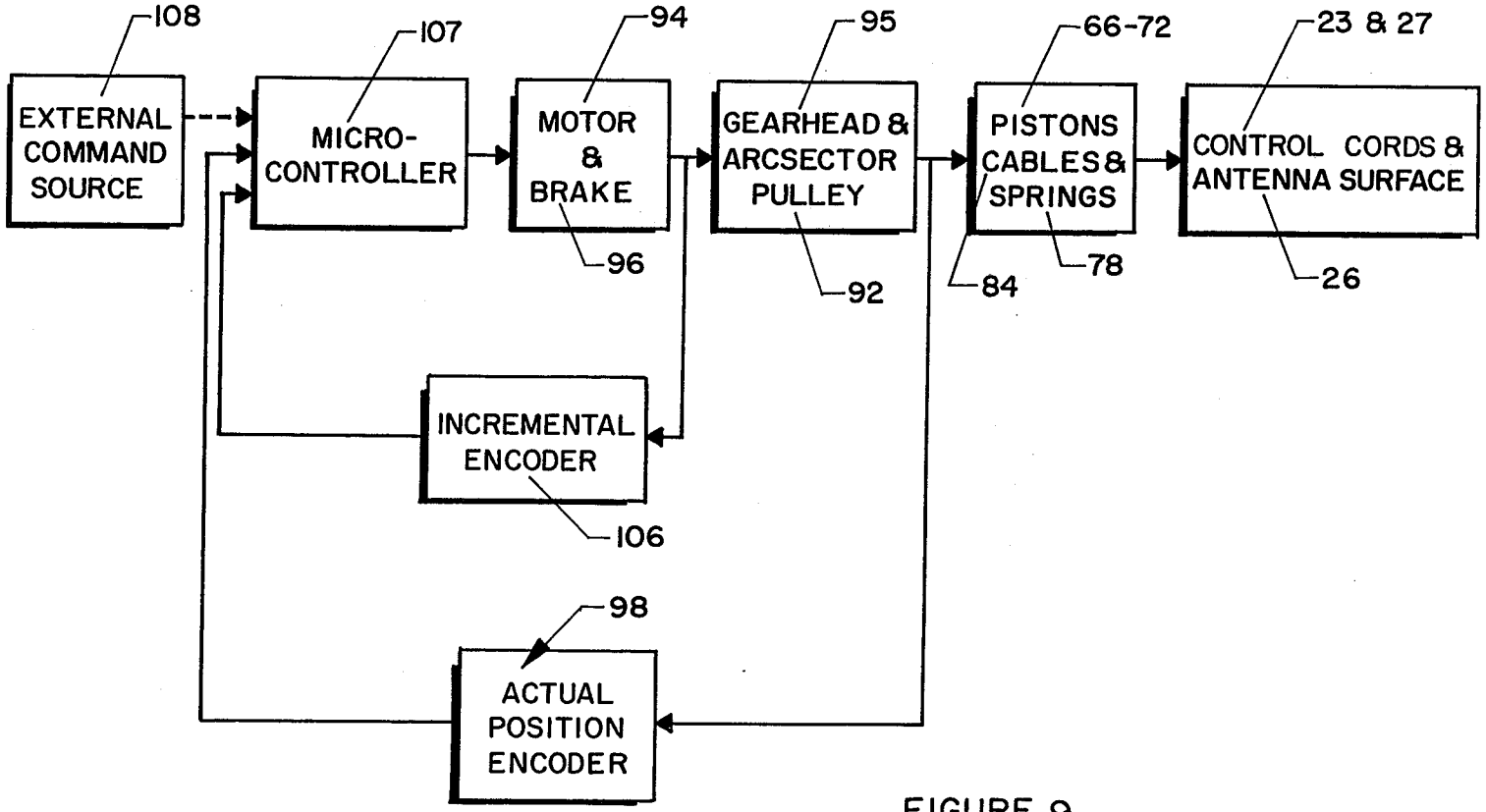
FIG. 9 is a block diagram of the control system of the invention.

As shown in FIG. 9 the position signals from the incremental coder 106 and actual position encoder 98 are fed to the micro-controller 107 which compares the actual arc-sector point position signals with the ideal position signals and energizes the individual motors in each assembly 56 as required to rotate the respective drive pulleys 92 associated therewith to the zero degree position for each arc-sector point 91 at which time the ideal and actual position signals are equal. The respective motors 94 are de-energized and its associated brake motor 96 turned on.

The micro-controller 107 includes circuit means that limit the degree of rotation of the associated drive pulleys 92 in any given direction to no more than the angle between the spaced holes 104 at which time the driving motor is reversed and the drive pulley 92 rotated in the opposite direction until the pair of holes 104 is sensed by the actual position encoder 98 and the index signal from the incremental encoder 106 are coincident. At that time the micro-controller 107 turns off the associated drive motor 94. Thus positioning of the arc-sector points 91 is accomplished by the micro-controller 107 which selectively drives one or all of the torque motors 94 associated therewith while monitoring the output signals of the actual position encoder 98 and the incremental encoder 106. Rotation of the arc-sector points is transferred as a reciprocating movement to the pistons 68–72 by the actuator cables 84.

Each surface control cord 27 and lower hoop control cord 23 may be automatically and individually adjusted to control the three-dimensional position of that portion of the antenna surface to which attached. The five control cords in each control cord group 28 may be adjusted in sequence or simultaneously by properly programming the micro-controllers 106 with which associated assuming sufficient power is available. Further the system may be arranged to operate all twenty-four (24) actuator assemblies simultaneously or in any desired sequence or combination, again as determined by the programming of the micro-controllers 106 and the availability of sufficient power.

As shown in FIG. 9, position command signals from an external command source 108 may be provided for controlling the contour of the antenna surface 26 as previously described using three-dimensional photographs of the deployed antenna which may be taken in space from the antenna itself, another space object, or from the Earth. These photographs may be computer processed into ideal arc-sector point position command signals corresponding to each respective actuator cable 84. The external command signals are compared with the corresponding actual position arc-sector signals and the arc-sector points 91 in need of adjustment rotated and positioned until the actual position signals and external ideal position signals are the same as previously described.

Subsequent detailed photographs may be taken periodically and this photogrammatic process repeated to automatically and continuously maintain the desired surface contour of the fully deployed antenna.

While the invention has been described for use with a hoop-column mesh antenna, it may be used to control the surface contour of any mesh-type antenna including radial rib, rap rib, or tetrahedral truss antennae for example and in which the use of surface cords as in this invention is desirable.

Therefore, while a preferred embodiment of the invention has been described in detail numerous changes and modifications can be made within the principles thereof.

We claim:

1. In a system for controlling the contour of the three-dimensional surface of an antenna deployed and supported by a plurality of surface control cords attached to selected points on the surface of said antenna, the relative three-dimensional position of each of said selected points on said antenna surface being determined by individually adjusting the length of each of said surface control cords to control the contour of the surface of said three-dimensional antenna the improvement comprising:

actuator assembly means including motor driven means for automatically and individually sensing and adjusting the actual length of each of said surface control cords to a predetermined length thereby controlling the contour of the surface of said antenna, said motor driven means including stop means for limiting the length of adjustment of each of said individual surface control cords.

2. A system for controlling the contour of a three-dimensional surface of an antenna deployed and supported by a circular hoop means affixed to a central column by attachment means including a plurality of hoop control cords attached to selected points on and said hoop means and to a base member of said central column and a plurality of surface control cords each attached to said base member at one end and at selected points on the surface of said antenna at the other end, the relative three-dimensional positions of said selected points on said hoop means and said antenna surface being determinative of the contour of the surface of said three-dimensional antenna comprising:

actuator assembly means including motor driven means for automatically and individually sensing and adjusting the actual length of each of said hoop and surface control cords to a predetermined length thereby determining the relative three-dimensional position of each of said selected points to control the contour of the surface of said antenna, said motor driven means including stop means for limiting the length of adjustment of each of said individual surface control cords.

3. The invention as defined in claim 2 wherein the lengths of said hoop and surface control cords are sensed and adjusted simultaneously.

4. The invention as defined in claim 2 wherein the lengths of said hoop and surface control cords are sensed and adjusted in sequence.

5. The invention as defined in claim 2 wherein said hoop and surface control cords are arranged in cord groups, each cord group including at least one hoop control cord and at least one surface control cord.

6. The invention as defined in claim 5 wherein each control cord group includes one hoop control cord and four surface control cords.

7. In a system for controlling the contour of a three-dimensional surface of an antenna deployed and supported by a circular hoop means affixed to a central column by attachment means including a plurality of hoop control cords attached to selected points on said hoop means and to a base member of said central column and a plurality of surface control cords each attached to said base member at one end and at selected points on the surface of said antenna at the other end, said hoop and surface control cords being arranged in a plurality of cord groups on said central base, each cord group including at least one hoop control cord and one surface control cord, the relative three-dimensional position of each of said selected points on said hoop means and said antenna surface being determinative of the contour of the surface of said antenna, the improvement comprising:

an actuator assembly means for each of said cord groups mounted on said central base, said actuator assembly means including a stop block having individual and displaceable piston means therein secured to each of said hoop and surface control cords in each of said cord groups;

an actuator cable attached to each of said piston means at one end and tangentially to an arc-sector point on a drive pulley at the other;

individual motor driven shaft means including an actual arc-sector point position encoder means for automatically and individually sensing and adjusting the sensed length of each of said respective hoop and surface control cords to a predetermined length thereby controlling the contour of the surface of said antenna.

8. In a system for controlling the contour of a three-dimensional surface of an antenna deployed and supported by a circular hoop means affixed to a central column by attachment means including a plurality of hoop control cords attached to selected points on said hoop means and to a base member of said central column and a plurality of surface control cords each attached to said base member at one end and at selected points on the surface of said antenna at the other end, said hoop and surface control cords being arranged in a plurality of cord groups on said central base, each cord group including at least one hoop control cord and one surface control cord, the relative three-dimensional position of each of said selected points on said hoop means and said antenna surface being determinative of the contour of the surface of said antenna, the improvement comprising:

an actuator assembly means for each of said cord groups mounted on said central base, each of said actuator assembly means including a stop block having a displaceable piston means therein secured to each of said hoop and surface control cords in each control cord group;

an actuator cable attached to each of said piston means at one end and tangentially to an arc-sector point on a drive pulley at the other;

individual motor means for reversibly rotating each of said drive pulleys and an actual position encoder means responsive to an arc-sector point sensor means for providing actual arc-sector point position signals;

incremental encoder means for energizing said motor means when actuated; and controller means for providing and comparing internal ideal arc-sector point position signals with said actual arc-sector point position signals and actuating said incremental encoder means until said actual arc-sector point position signals equal said ideal arc-sector point signals thereby automatically and individually adjusting the length of said control cords to control the contour of each of the surface of said antenna.

9. The invention as defined in claim 8 including brake means that are on when said individual motor means are off and off when said individual motor means are on.

10. The invention as defined in claim 9 including stop means for limiting the displacement of said pistons in said stop block.

11. The invention as defined in claim 9 wherein said controller is responsive to and compares external ideal arc-sector point position signals with said actual arc-sector point position signals and actuates said incremental encoder until the actual arc-sector point position signals equal the external ideal arc-sector point position signals.

* * * * *